US005537700A

United States Patent [19]

Way et al.

[11] Patent Number: 5,537,700

[45] Date of Patent: Jul. 23, 1996

[54] EMERGENCY STRETCHER WITH X-FRAME SUPPORT

[75] Inventors: Christopher B. Way; John M. Arend, both of Kalamazoo Township, Kalamazoo County; Christopher Gentile, Sherman Township, St. Joseph County, all of Mich.

[73] Assignee: Stryker Corporation, Kalamazoo, Mich.

[21] Appl. No.: 229,723

[22] Filed: Apr. 19, 1994

[51] Int. Cl.[6] ..... A61G 1/02; A61G 1/04; A61G 1/013

[52] U.S. Cl. ..... 5/611; 5/86.1; 296/20

[58] Field of Search ..... 5/81.1, 86.1, 611, 5/424, 425; 296/20

[56] References Cited

U.S. PATENT DOCUMENTS

| | | | |
|---|---|---|---|
| 2,958,873 | 11/1960 | Ferneau | 296/20 |
| 3,122,758 | 3/1964 | Ferneau . | |
| 3,380,085 | 4/1968 | Ferneau et al. . | |
| 3,644,944 | 2/1972 | Bourgraf et al. | 5/86.1 |
| 3,759,565 | 9/1973 | Ferneau | 296/20 |
| 4,037,871 | 7/1977 | Bourgraf et al. | 5/110 |
| 4,097,941 | 7/1978 | Merkel | 5/81.1 |
| 4,688,279 | 8/1987 | Vance | 5/81.1 |
| 4,767,148 | 8/1988 | Ferneau et al. | 296/20 |
| 5,063,624 | 11/1991 | Smith et al. | 5/86.1 |
| 5,271,113 | 12/1993 | White | 5/611 |

FOREIGN PATENT DOCUMENTS 952534 3/1964 United Kingdom .

*Primary Examiner*—Alexander Grosz
*Attorney, Agent, or Firm*—Flynn, Thiel, Boutell & Tanis

[57] ABSTRACT

An emergency stretcher for emergency vehicles includes an X-frame litter support mechanism that vertically movably supports a patient litter on a wheeled base. Each of the legs of the litter support mechanism have the capability to expand and contract in length, and a fixed-length link member extends between the base and one of the legs. A releasable locking arrangement can releasably lock the patient litter in a selected vertical position, and can be released only when the patient litter is manually lifted. A gas cylinder which controls the angular position of a pivotally supported upper body support member can move into a recess in a cross member of the patient litter.

15 Claims, 9 Drawing Sheets

EMERGENCY STRETCHER WITH X-FRAME SUPPORT

FIELD OF THE INVENTION

The present invention relates to an emergency stretcher which can be loaded into an emergency vehicle and, more particularly, to such a stretcher with an improved X-frame support and locking mechanism.

BACKGROUND OF THE INVENTION

Specialized stretchers are used with emergency vehicles such as ambulances, in part to permit the stretcher to be easily loaded into different ambulances having different internal floor heights. Examples of such prior stretchers are disclosed in U.S. Pat. Nos. 4,097,941, 4,767,148, 4,037,871 and 3,644,944. Although these pre-existing stretchers have been generally adequate for their intended purposes, they have not been satisfactory in all respects.

For example, it is sometimes possible to disengage the releasable locking mechanism when the patient litter is not fully supported by manual lifting, resulting in a rapid drop of the patient litter with an abrupt stop in its lowermost position, which can result in patient injury. Also, prior stretchers may have a pivotally-supported upper body support section which can be maintained in a desired position by a selectively actuatable gas cylinder, but the vertical thickness of the patient litter must usually be increased beyond a desirable amount in order to provide clearance for movement of the gas cylinder with respect to transversely-extending cross members that rigidify the frame.

Accordingly, one object of the present invention is to provide an emergency stretcher with an improved X-frame support, with a safety mechanism which prevents a release of the locking mechanism for the vertical height adjustment except when the patient litter is substantially completely supported by manual or other external lifting forces, and with an arrangement which permits use of a gas cylinder for the upper body support member while maintaining a reasonably compact construction of limited vertical thickness for the patient litter.

SUMMARY OF THE INVENTION

The objects and purposes of the invention, including those set forth above, are met according to one form of the invention by providing a stretcher which includes: a wheeled base; a patient litter disposed above the base; a support mechanism which supports the patient litter for vertical movement relative to the base, the support mechanism including elongate first and second support elements which each have first and second ends respectively pivotally coupled to the patient litter and to the base, which can each expand and contract in length, and which are pivotally coupled to each other at locations between the ends thereof for pivotal movement about an approximately horizontal pivot axis; and a selectively actuatable locking arrangement for releasably locking the support mechanism so as to respectively permit and prevent vertical movement of the patient litter relative to the base when respectively actuated and deactuated.

According to a different form of the present invention, a stretcher includes: a wheeled base; a patient litter disposed above the base; a support mechanism which supports the patient litter for vertical movement relative to the base; and a selectively actuatable locking arrangement cooperable with the support mechanism for releasably locking the patient litter in a selected vertical position with respect to the base, the locking arrangement including a safety arrangement for preventing a release of the locking arrangement except when the patient litter is subject to an external lifting force sufficient so that the support mechanism is substantially free from the exertion thereon of downward forces from the patient litter.

According to yet another form of the present invention, a stretcher includes: a wheeled base; a support mechanism disposed on the base; a patient litter which is supported on the support mechanism at a location above the base, the patient litter including a frame supported on the support mechanism and a patient support provided on the frame, the patient support including an articulatable member movable relative to the frame between an inclined position and an approximately horizontal position; and an elongate position control device which has a selectively actuatable arrangement for respectively permitting and preventing a change in the length thereof when respectively actuated and deactuated, and which has two ends respectively pivotally coupled to the frame and the articulatable member; wherein the frame has spaced parallel side members extending lengthwise of the stretcher and has a cross member extending transversely between the side members, the cross member having an upwardly open recess in a central portion thereof and a portion of the position control device moving into the recess as the articulatable member moves to the approximately horizontal position.

BRIEF DESCRIPTION OF THE DRAWINGS

Preferred embodiments of the present invention will be described in detail hereinafter with reference to the accompanying drawings, in which.

DETAILED DESCRIPTION

Figure 1:
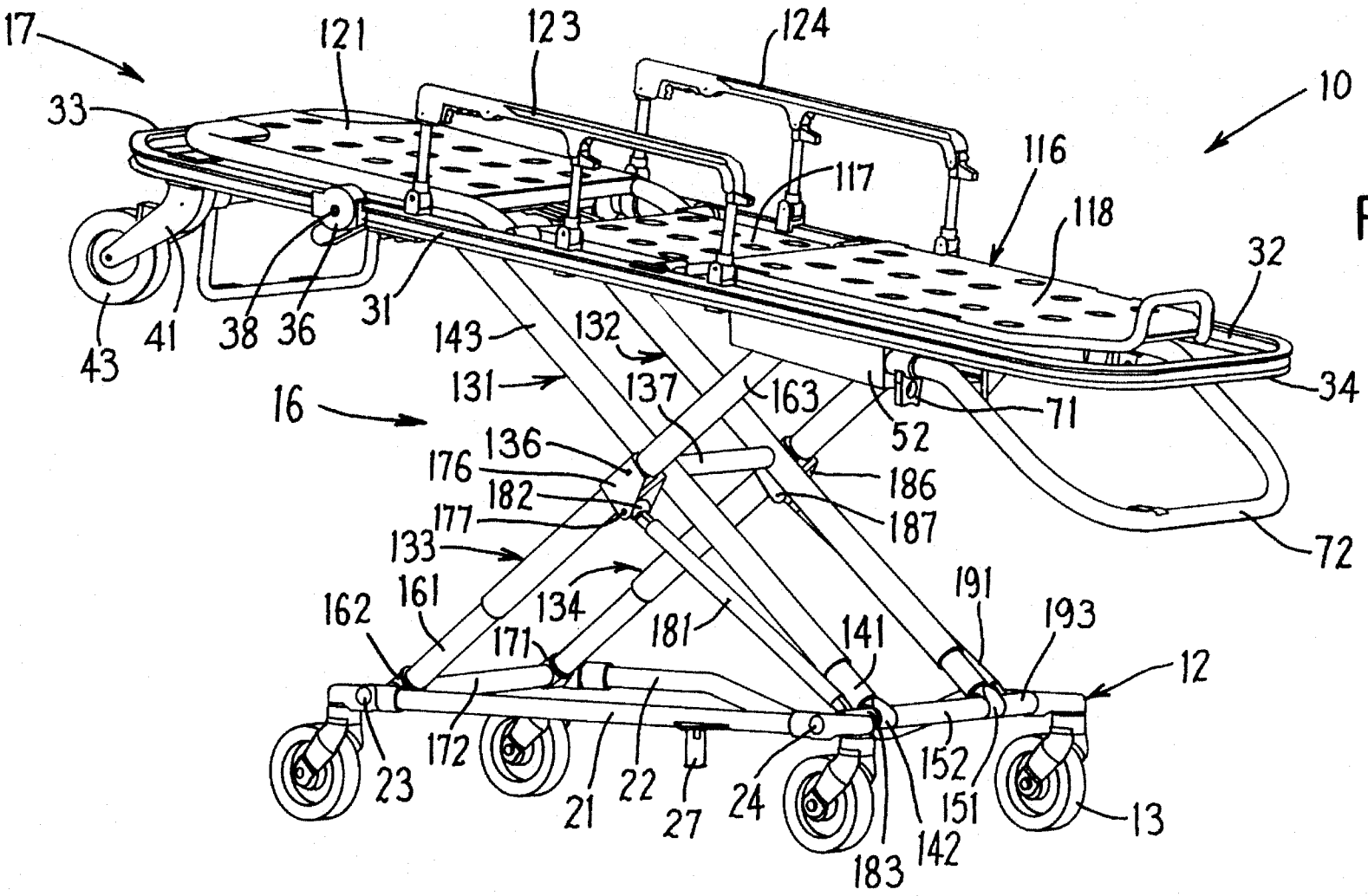
FIG. 1 is a perspective view of an emergency stretcher which embodies the present invention, with protective bellows omitted from telescoping legs thereof for purposes of clarity.
Figure 2:
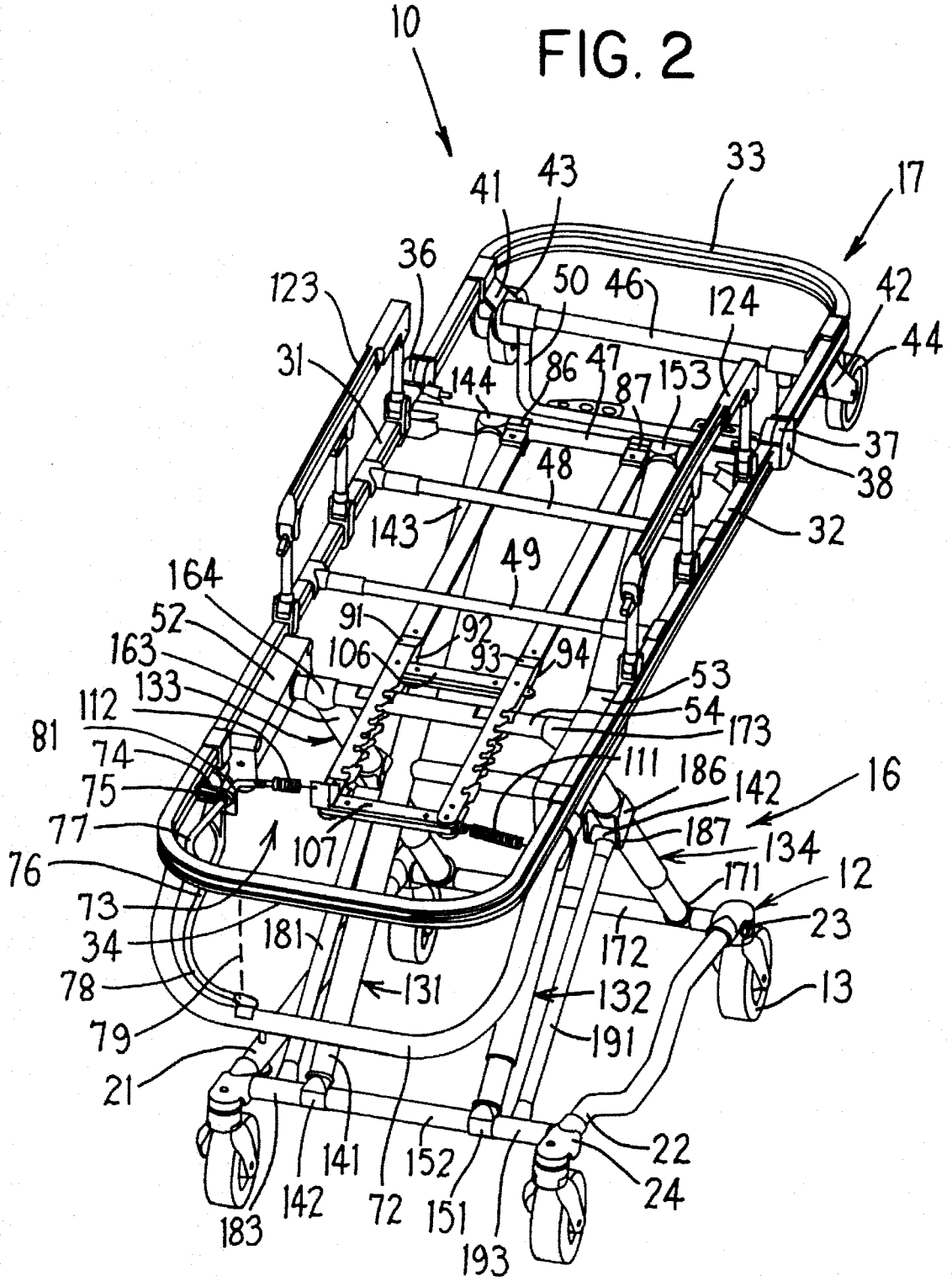
FIG. 2 is a perspective view from a different angle of the emergency stretcher of FIG. 1, with an articulatable patient support omitted for purposes of clarity.

Referring to FIGS. 1 and 2, reference numeral 10 designates an emergency stretcher which is specifically designed to be rolled into ambulances or other emergency vehicles having different floor heights. The stretcher 10 includes a base 12 movably supported by four casters 13, a litter support mechanism 16 supported on the base and having an adjustable vertical height, and a patient litter 17 supported on the litter support mechanism 16. The base 12 is an approximately rectangular frame with the four casters 13 located at its corners, the frame including two approximately parallel side members 21 and 22, and two end members 23 and 24 which are each a cylindrical metal rod, only the ends of the end members 23 and 24 being visible in FIGS. 1 and 2. The side members 21 and 22 are fixedly secured to the end members 23 and 24 by fixtures which rotatably support the casters, and thus the base 12 does not change in length or width during use of the stretcher 10. A short post 27 is fixedly secured to and projects downwardly from the side member 21, and is a conventional connecting part that can releasably cooperate with a conventional locking mechanism commonly found in ambulances, in order to hold the stretcher 10 against movement within the ambulance during travel of the ambulance.

The vertically adjustable litter support mechanism 16 will be described in detail after the patient litter 17 has been described. The patient litter 17 has a generally rectangular frame which includes two elongate and parallel side members 31 and 32, and two parallel end members 33 and 34. The side member 31 consists of two separate sections which are located on opposite sides of and are pivotally coupled by a mechanism 36, and the side member 32 consists of two separate sections which are pivotally coupled by a mechanism 37. The end member 33 and the adjacent sections of side members 31 and 32 can thus pivot downwardly about a transverse horizontal axis 38 from the approximately horizontal position shown in FIGS. 1 and 2 to a downwardly extending position in which the end member 33 is approximately beneath the pivot axis 38. Normally, the pivot mechanisms 36 and 37 are releasably locked in the position shown in FIGS. 1 and 2. The pivotal movement which they implement is not the focus of the present invention, and is therefore not described in further detail.

Respective brackets 41 and 42 are fixedly secured on the side members 31 and 32 at the ends thereof adjacent end member 33, and each of the brackets 41 and 42 rotatably supports a respective loading wheel 43 or 44. The wheels 43 and 44 facilitate insertion of the stretcher 10 into an emergency vehicle.

Referring to FIG. 2, a cylindrical cross member 46 extends between and has its ends disposed in respective short tubes which are each fixedly secured to one of the brackets 41 and 42, in order to stabilize the brackets and rigidify the frame of the patient litter 17. Similarly, cylindrical cross members 47, 48 and 49 have their ends disposed in respective short tubes secured to the side members 31 and 32 at spaced locations therealong. The cross member 46 also pivotally supports a safety hook 50, which is not pertinent to an understanding of the present invention and is therefore not described in detail.

Figure 3:
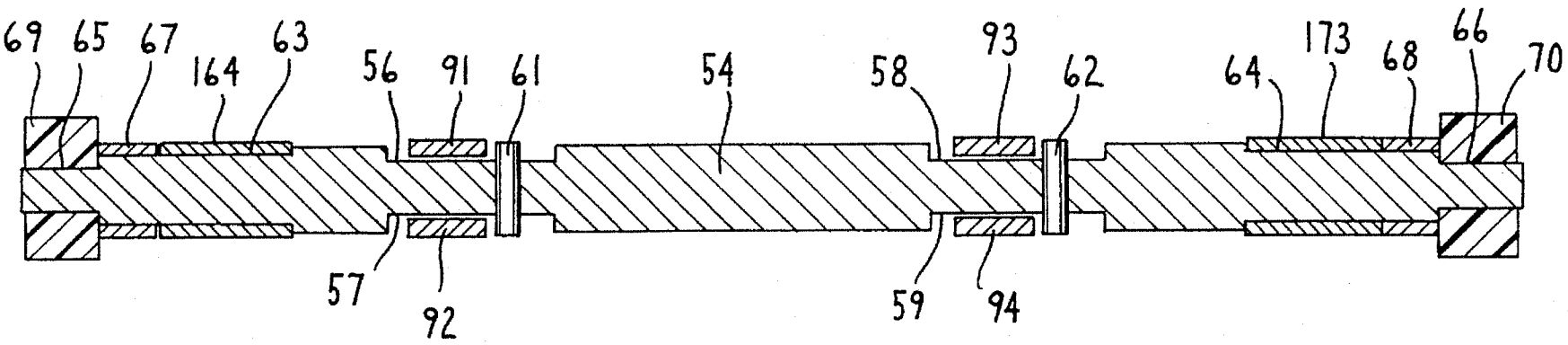
FIG. 3 is a central sectional view of a movable cross member and elements cooperating therewith, all of which are components of the embodiment of FIG. 1.

Two brackets 52 and 53 are secured to the inwardly facing sides of the side members 31 and 32 at locations spaced a small distance from end member 34, and each of the brackets 52 and 53 has therein a horizontal slot which extends at a small angle with respect to the side members 31 and 32 and which opens toward the other bracket. More specifically, in a direction from end member 34 toward end member 33, each slot extends upwardly at an angle of 3° with respect to the side members 31 and 32. Referring to FIGS. 2 and 3, a further cylindrical cross member 54 has each end disposed within a slot in a respective one of the brackets 52 and 53, movement of the ends of cross member 54 within the slots permitting the cross member 54 to carry out limited movement relative to the frame in a direction lengthwise of the patient litter 17. As best seen in FIG. 3, the cross member 54 has on its upper side two spaced and upwardly facing flat surfaces 56, 58 and has on its underside two spaced and downwardly facing flat surfaces 57 and 59 which are respectively disposed below and parallel to the surfaces 56 and 58. Two cylindrical locking pins 61 and 62 each extend vertically through and are fixedly secured in the cross member 54, the upper ends of pins 61 and 62 respectively projecting above the surfaces 56 and 58, and the lower ends of pins 61 and 62 respectively projecting below the surfaces 57 and 59.

Near its outer ends, the cross member 54 has two cylindrical portions 63 and 64 of reduced diameter, and has at its outer ends two further portions 65 and 66 of square cross-sectional shape. Spacer sleeves 67 and 68 are provided around the outer ends of portions 63 and 64, and two end members 69 and 70 are respectively provided on the end portions 65 and 66. The end members 69 and 70 are made of nylon or a similar material, have a rectangular shape when viewed in a direction parallel to the centerline of cross member 54, are slidably disposed in the slots within the brackets 52 and 53, and have square central openings which non-rotatably receive the square ends 65 and 66 of the cross member 54.

Figure 8:
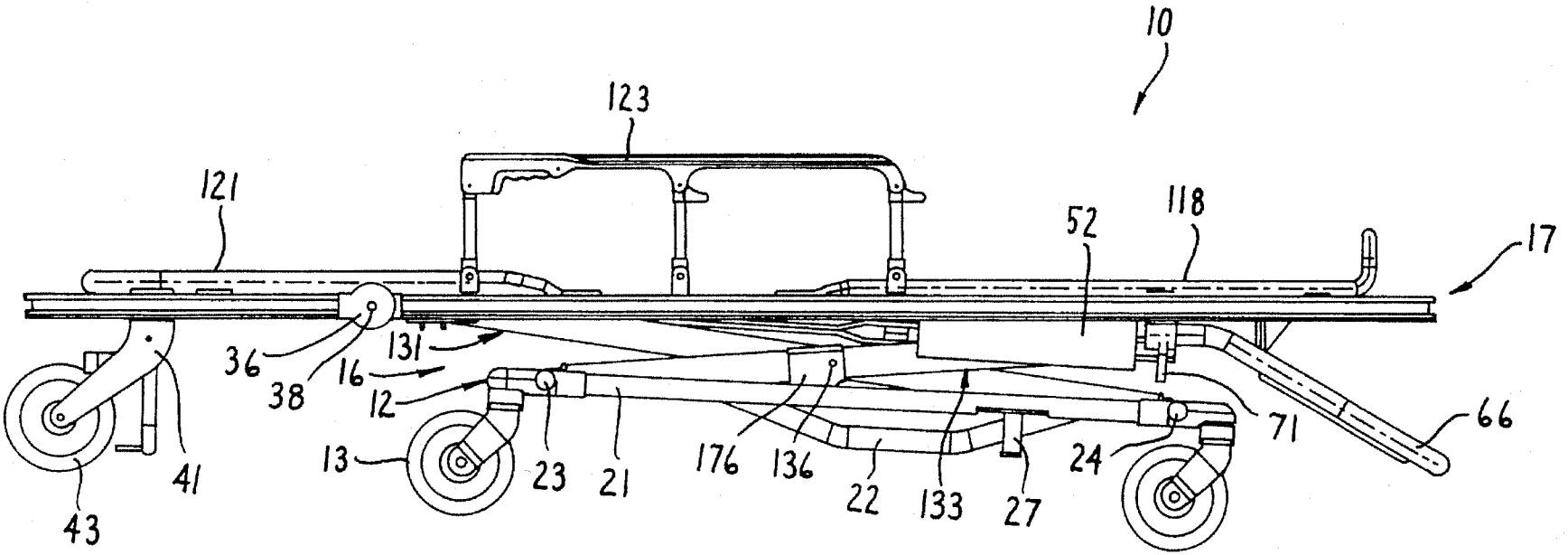
FIG. 8 is an elevational side view of the stretcher of FIG. 1, in a different operational position.

As best seen in FIGS. 1 and 8, a pair of dead stop brackets 71 are respectively fixedly secured to the side members 31 and 32 adjacent the brackets 52 and 53, and can engage the base 12 when the support mechanism 16 has the patient litter 17 in its lowermost position, to transfer weight directly from the litter 17 to the base rather than through mechanism 16. A U-shaped auxiliary handle 72 has the ends of its legs fixedly secured to the respective dead stop brackets 71, is disposed below the end member 34 and below adjacent portions of side members 31 and 32 in approximate alignment therewith when viewed in a top view, and is inclined to diverge away from side members 31 and 32 in a direction away from brackets 71.

As mentioned above, and as described in more detail later, the litter support mechanism 16 has a vertically adjustable height, so that the vertical position of the patient litter 17 can be adjusted relative to the base 12. With reference to FIGS. 2–5, the patient litter 17 includes a releasable locking mechanism 73 which can be selectively actuated and deactuated in order to permit and prevent adjustment of the vertical height of the patient litter 17 with respect to the base 12.

More specifically, the releasable locking mechanism 73 includes a bracket 74 which is fixedly mounted on the inner side of the side member 31 between the bracket 52 and the end member 34, and which has a horizontally extending slot 75 through it. A V-shaped release member 76 has two legs 77 and 78 with their outer ends respectively pivotally supported on the end member 34 and the auxiliary handle 72 for movement about a common vertical pivot axis 79. The apex portion 81 of the V-shaped release member 76 is slidably disposed in the transverse horizontal slot 75 in the bracket 74. The slot 75 thus controls the range of pivotal movement of the release member 76, which in particular can move between a normal position shown in FIG. 4 and a release position shown in FIG. 5.

Figure 4:
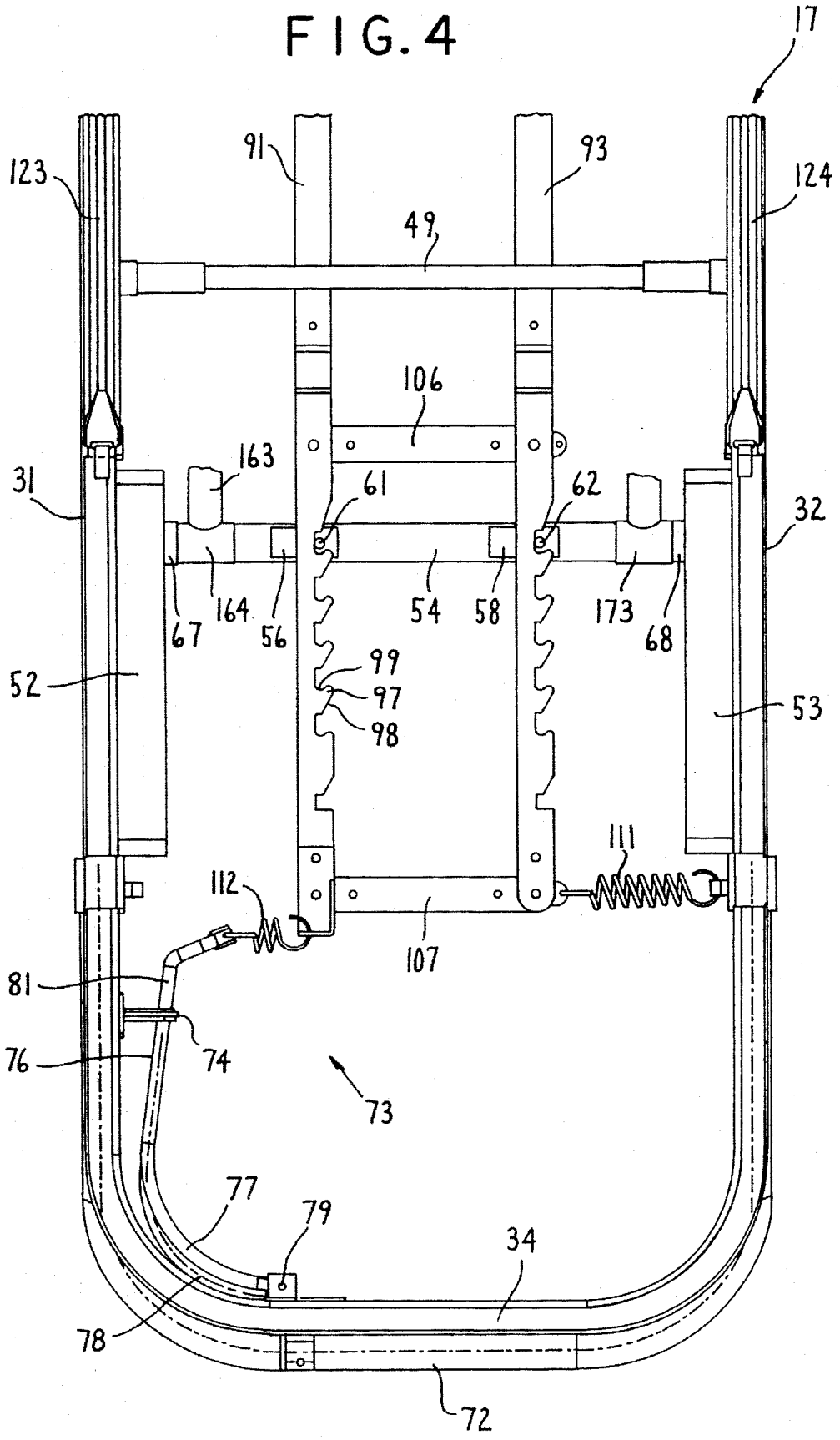
FIG. 4 is a top view of a portion of the emergency stretcher shown in FIG. 2.
Figure 5:
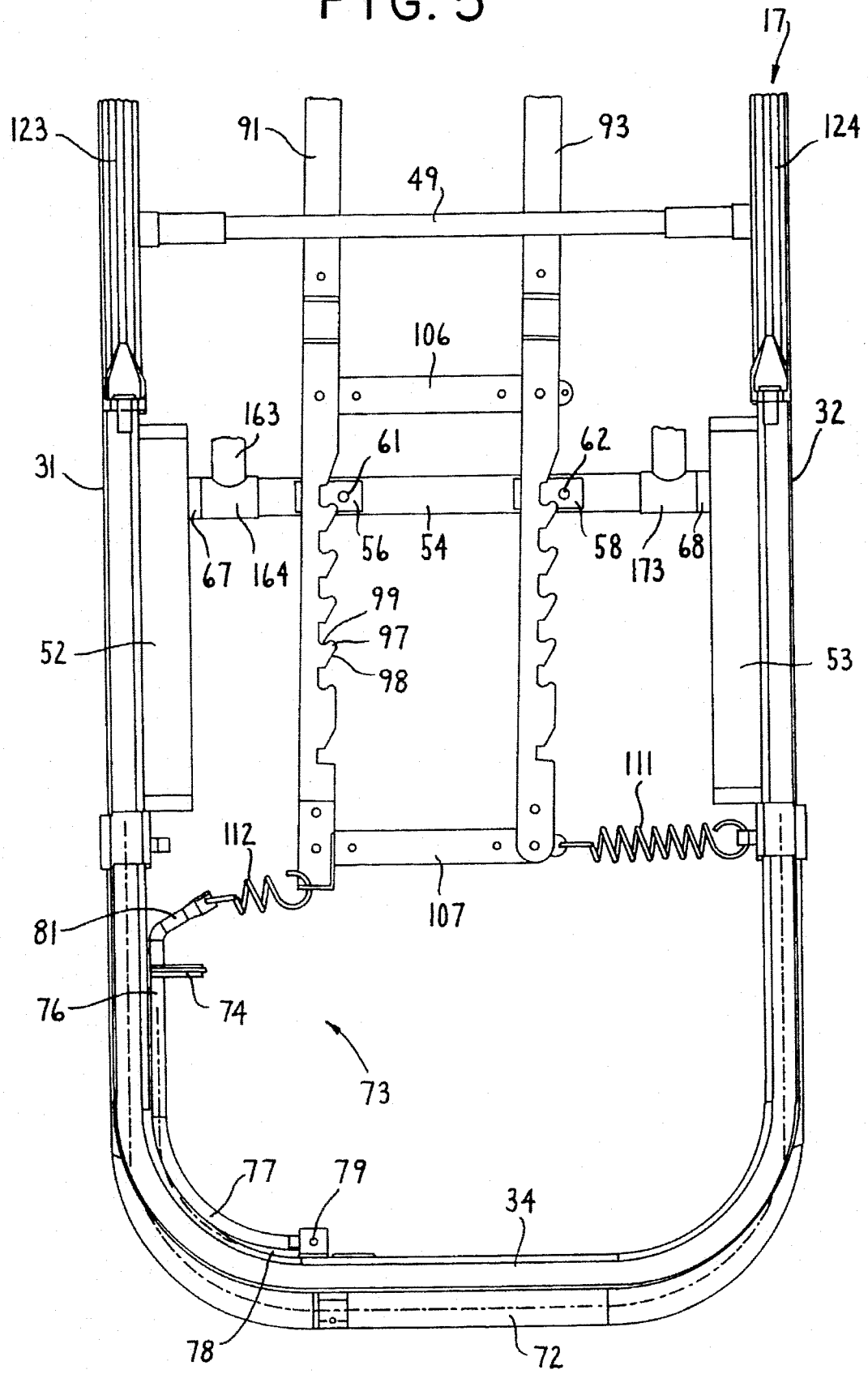
FIG. 5 is a top view similar to FIG. 4, but showing a different operational position.

The releasable locking mechanism 73 also includes, with reference to FIG. 2, two brackets 86 and 87 which are fixedly secured at spaced locations on the cross member 47. Two elongate metal locking strips 91 and 92 each have one end pivotally supported on the bracket 86 for movement about a vertical axis, extend horizontally away from the bracket 86 closely adjacent each other for slightly more than half their length, and then are bent so that their end portions remote from the bracket 86 are vertically spaced and parallel to each other, the cross member 54 being disposed between the metal strips 91 and 92 with the strips 91 and 92 respectively adjacent the flat surfaces 56 and 57, as best seen in FIG. 3. Similarly, two additional elongate metal locking strips 93 and 94 are each pivotally supported at one end on the bracket 87, extend horizontally away from bracket 87 closely adjacent each other for approximately half their length, and are then bent so that the end portions remote from bracket 87 are vertically spaced and parallel, the spaced end portions being respectively adjacent flat surfaces 58 and 59. As best seen in FIGS. 4 and 5, the vertically spaced end portions of the metal strips 91–94 each have along edges thereof which face the adjacent pin 61 or 62 a series of recesses defining saw-shaped locking teeth 97, each of the locking teeth 97 having on a side thereof nearest the end member 34 an inclined surface 98, and having on the side thereof facing the pivot axes of the metal strips 91–94 a semicircular recess 99 with a diameter slightly larger than the diameter of the pins 61 and 62.

A connecting member 106 has one end disposed between the plates 91 and 92 and supported thereon for pivotal movement about a vertical axis, and has its opposite end disposed between the plates 93 and 94 and supported thereon for rotation about a further vertical axis. The connecting member 106 is located near the bent portions of the metal strips 91–94. The connecting member 106 is not essential, and could be omitted. A further connecting member 107 is disposed at the outer ends of the metal strips 91–94, and has one end disposed between the strips 91 and 92 and supported thereon for pivotal movement about a vertical axis, and its opposite end disposed between the strips 93 and 94 and supported thereon for pivotal movement about a vertical axis. The connecting members 106 and 107 and the end portions of the strips 91–92 and 93–94 define a parallelogram which permit the strips 91–94 to pivot about their respective pivot axes at the brackets 86 and 87, so that their end portions between the connecting members 106 and 107 carry out a limited amount of movement generally transversely of the bed, in particular between the positions shown in FIGS. 4 and 5.

The releasable locking mechanism 73 also includes a helical expansion spring 111 which has one end fixedly supported on the side member 32 of the frame, and its other end coupled to the adjacent end of connecting member 107. A further helical expansion spring 112 has one end coupled to the outer end of the apex portion 81 of the release member 76, and its opposite end coupled to a plate welded or bolted to the outer end of metal strip 91. The relative strengths of the springs 111 and 112 are selected so that, when no manual force is applied to the release member 76, the spring 111 pulls the metal strips 91–94 to the position shown in FIG. 4, the metal strip 91 in turn pulling spring 112 and release member 76 to the normal position shown in FIG. 4. The relative strengths are also such that, when the release member 76 is manually pulled to the release position shown in FIG. 5, the spring 112 will exert on member 107 a force slightly greater than that exerted by spring 111, so as to urge the metal strips 91–94 to pivot to the release position shown in FIG. 5.

Referring to FIG. 1, the frame of the patient litter 17 carries a patient support 116. The patient support 116 includes a center member 117 fixedly mounted on a central portion of the frame, a foot support member 118 which is pivotally supported at its end nearest center member 117 for movement about a transverse horizontal axis between the horizontal position shown in FIG. 1 and an inclined position, and an upper body support member 121 which is pivotally supported at its end nearest center member 117 for movement about a further transverse horizontal axis between the horizontal position shown in FIG. 1 and an inclined position. The patient support 116 has been omitted in some of the other figures for purposes of clarity.

Referring to FIGS. 1 and 2, a pair of conventional collapsible side rails 123 and 124 are provided on the side members 31 and 32 on opposite sides of the patient litter 17. The side rails 123 and 124 are conventional and not the focus of the present invention, and are therefore not described in further detail.

The vertically adjustable litter support mechanism 16 will now be described in detail. Referring to FIGS. 1–3 and 6, the litter support mechanism 16 includes two parallel telescoping legs 131 and 132 which each have a lower end pivotally supported on the end member 24 of the base and an upper end pivotally supported on the cross member 47 of the patient litter, and includes two further telescoping parallel legs 133 and 134 which are disposed on the outer sides of the legs 131 and 132, and which each have a lower end pivotally supported on the end member 23 of the base and an upper end pivotally supported on the cross member 54 of the patient litter. A horizontal axle 136 extends transversely and radially through each of the legs 131–134, in order to pivotally support legs 131–132 with respect to legs 133–134. A sleeve-like spacer 137 is provided on the axle 136 between the legs 131 and 132 in order to maintain a desired spacing therebetween.

Figure 6:
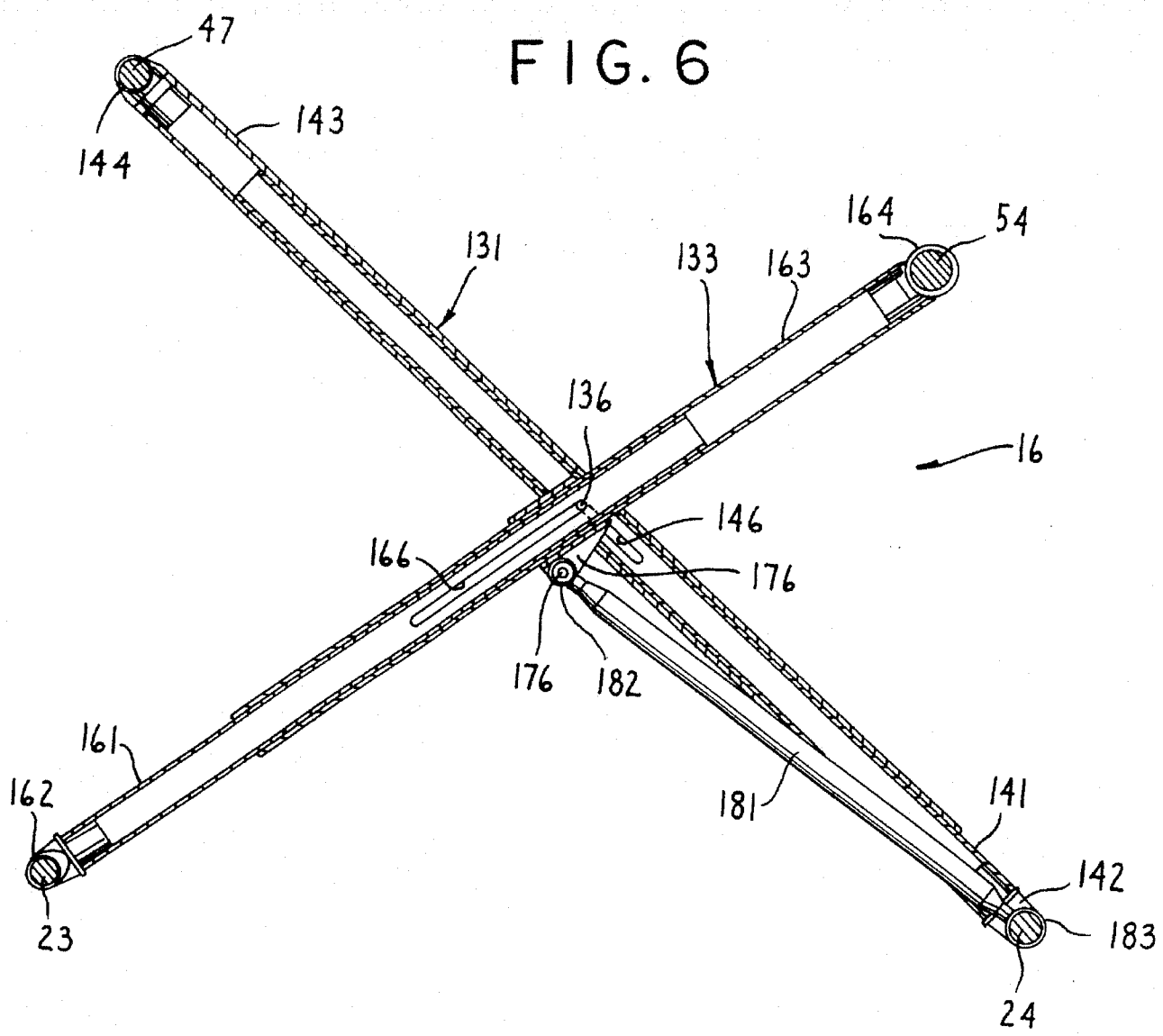
FIG. 6 is a sectional side view of an X-frame support mechanism of the stretcher of FIG. 1.

Looking at the structure of the legs in greater detail, legs 131 and 132 are substantially identical, and therefore only leg 131 is described in detail. As best seen in FIG. 6, leg 131 includes an inner tube 141 having fixedly mounted to the lower end thereof a sleeve 142 which is rotatably supported on end member 24, and has an outer tube 143 with a sleeve 144 fixedly secured to the upper end thereof and rotatably supported on the cross member 47. In particular, as shown in FIG. 2, the sleeve 144 is disposed axially between the bracket 86 and the tube on the frame which holds the end of cross member 47. The outer tube 143 has an inside diameter which is slightly greater than the outside diameter of the inner tube 141, the inner tube 141 being axially slidably received within the outer tube 143. The inner tube 141 has axial slots 146 in opposite side walls and the axle 136 extends through the slots, in order to permit movement of tube 141 with respect to both axle 136 and tube 143.

The telescoping leg 132 is effectively identical to leg 131, and has at its lower end a sleeve 151 (FIG. 1) rotatably supported on the end member 24 and held in a spaced relation from the sleeve 142 by a sleeve-like spacer 152. The leg 132 has at its upper end a sleeve 153 (FIG. 2) which is disposed axially between the bracket 87 and the tube on side member 32 which supports the end of cross member 47.

In a similar manner, telescoping legs 133 and 134 are effectively identical, and only leg 133 is described in detail. As shown in FIG. 6, leg 133 has an inner tube 161, and a sleeve 162 is fixedly mounted to the lower end of inner tube 161 and is rotatably supported on end member 23. The leg 133 also has an outer tube 163 with a sleeve 164 fixedly mounted to the upper end thereof, the sleeve 164 being rotatably supported on the reduced diameter portion 63 (FIG. 3) of the cross member 54 adjacent sleeve 67. The inner tube 161 has an outside diameter slightly less than the inside diameter of outer tube 163, is axially slidably disposed within outer tube 163, and has a slot 166 (FIG. 6) through which the axle 136 extends in order to facilitate axial movement of inner tube 161 relative to outer tube 163 and axle 136. The telescoping leg 134 is similar, and has at the lower end a sleeve 171 (FIG. 1) which is rotatably supported on end member 23 and held in spaced relation to sleeve 162 by a sleeve-like spacer 172. The leg 134 has fixedly secured to its upper end a sleeve 173 which is disposed on the reduced diameter portion 64 (FIG. 3) of cross member 54 adjacent sleeve 68.

Referring to FIGS. 1 and 6, the outer tube 163 has a pair of identical and parallel flange plates 176 welded to opposite sides thereof so as to be perpendicular to axle 136, and a further axle 177 extends between the flange plates 176 parallel to axle 136, and has its ends fixedly supported on flange plates 176, the axle 177 being spaced radially from axle 136 and being spaced outwardly from the outer tube 163. A link member 181 of fixed length has a sleeve 182 which is fixedly secured to its upper end and which is rotatably supported on axle 177, and has a further sleeve 183 fixedly secured to its lower end and rotatably supported on end member 24 of the base between sleeve 142 and the adjacent caster 13. Similarly, as best seen in FIG. 2, the outer tube of the opposite leg 134 has a pair of flange plates 186 welded to it and has an axle 187 extending between and secured to the flange plates 186. A fixed link member 191 has secured to its upper end a sleeve 192 which is rotatably supported on axle 187, and has fixedly secured to its lower end a sleeve 193 which is rotatably supported on end member 24 between sleeve 151 and the adjacent caster.

Figure 7:
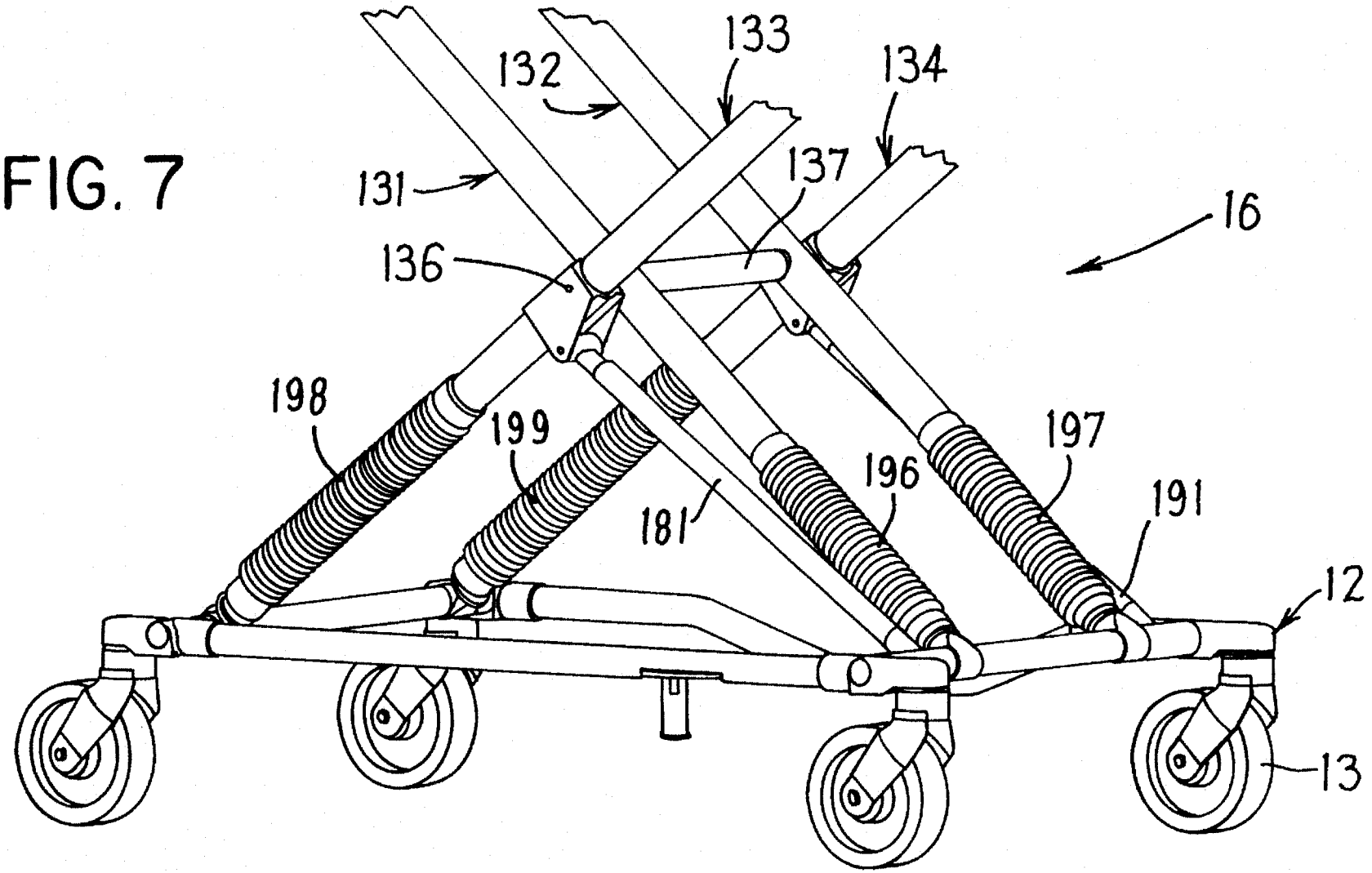
FIG. 7 is a perspective view of the lower portion of the stretcher of FIG. 1, showing the bellows which were omitted from FIGS. 1, 2 and 6.

Referring to FIG. 7, the telescoping legs 131–134 preferably have respective accordion-like cylindrical bellows 196–199 disposed around their lower ends to keep dust and dirt from entering between and interfering with movement of the telescoping tubes. The bellows 196–199 can be made of a suitable rubber or plastic material. The bellows 196–199 were omitted from FIGS. 1–6 so that the tubes of the telescoping legs could be clearly seen, but are an important part of the preferred embodiment and are therefore shown in FIG. 7 for purposes of completeness. In other respects, FIG. 7 is identical to the lower portion of FIG. 1.

FIG. 8 is a side view of the stretcher of FIG. 1, showing a different operational position in which the litter support mechanism 16 has been collapsed almost to its minimum vertical height, so that the patient litter 17 is closely adjacent the base 12. The manner in which the height adjustment is made will be described in detail later.

Figure 9:
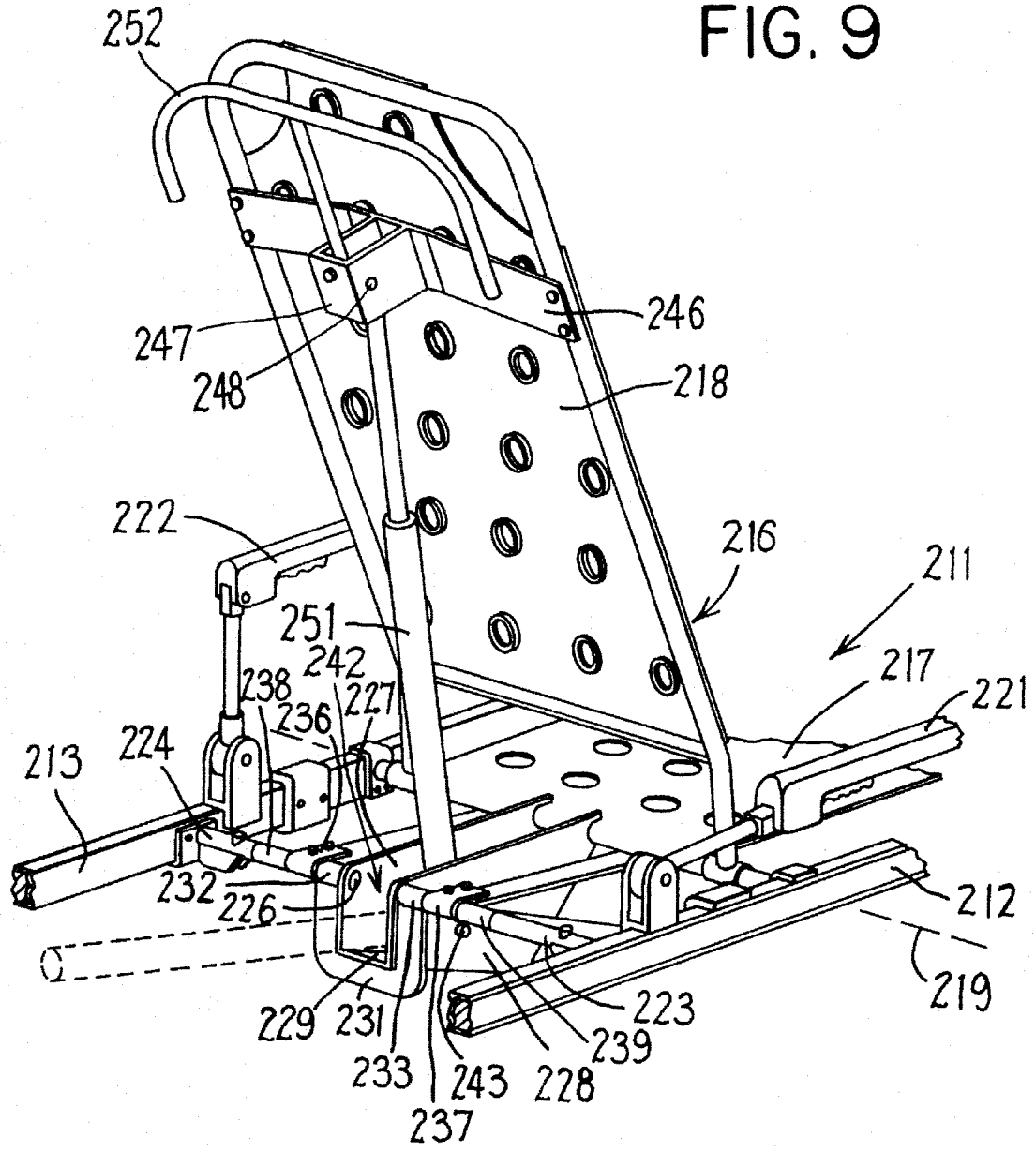
FIG. 9 is a fragmentary perspective view of part of an alternative embodiment of the stretcher of FIG. 1.

FIG. 9 shows a patient litter 211 which is a variation of the patient litter 17 of FIG. 1. Patient litter 211 has a frame with two parallel side members 212 and 213. The frame carries a patient support 216 which includes a center member 217 fixedly secured to the frame and an upper body support member 218 supported on a cross member 220 of the frame for pivotal movement about a transverse horizontal axis 219 located adjacent the center member 217. The side members 212 and 213 support respective collapsible side rails 221 and 222. The side members 212 and 213 also have inwardly projecting coaxial tubes 223 and 224 fixedly secured thereon. A cross member 226 includes two separate and coaxial cylindrical rod sections or segments each having an end disposed in a respective one of the tubes 223 and 224, only one axial end of one of the segments being visible in FIG. 9. Two spaced vertical plates 227 and 228 each have a circular opening which receives the inner end of a respective segment of the cross member 226, and have end portions which extend into respective slots provided in the center member 217 of the patient support 216 and which each have a not-illustrated hole through which the cross member 220 extends. A bottom plate 229 extends between and is welded to the lower edges of the vertical plates 227 and 228. A U-shaped reinforcing plate 231 extends around and is welded to the outer sides of the plates 227–229, and has sleeves 232 and 233 welded to the upper ends of its respective legs. The sleeves are also each welded to a respective vertical plate 227 or 228, and each receive therein an inner end portion of a respective segment of the cross member 226. The segments of the cross member 226 each have thereon a bracket 236 or 237 which correspond functionally to the brackets 86 and 87 in FIG. 2, and have thereon sleeves 238 and 239 for the telescoping legs which correspond functionally to the sleeves 144 and 153 in FIG. 2.

The vertical plates 227 and 228, in conjunction with the bottom plate 229, effectively define an upwardly open recess in the cross member 226 which opens downwardly to a point below the rod-like segments of the cross member 226. An axle 237 extends between and has its ends fixedly secured to the vertical plates 227 and 228, at a location vertically lower than and offset toward the foot end of the stretcher from the rod-like segments of cross member 226.

A plate 246 is fixedly secured to an outer portion of the upper body support member 218 on the underside thereof, and a U-shaped bracket 247 has the outer ends of its legs fixedly welded to the plate 246. The bracket 247 has an axle 248 extending between and fixedly secured to its legs, the axle 248 extending parallel to axle 243. A selectively actuatable telescoping gas cylinder 251 has its ends respectively pivotally supported on the axles 243 and 248. A manual operating lever 252 is movably supported on the bracket 247, and is mechanically coupled to the upper end of the gas cylinder 251. The gas cylinder 251 and the manner in which the operating lever 252 cooperates with it are conventional, and therefore not described in detail. When the operating lever 252 is manually actuated, the gas cylinder 251 permits the upper body support member 218 to pivot relative to the frame of the patient litter 211. When the operating lever 252 is not actuated, the gas cylinder 251 prevents movement of the upper body support member 218 so as to maintain it in its current position with respect to the frame of the patient litter.

The position of the lower pivot axis 243 of the gas spring 251 is important. When a patient is on the litter 211 and the upper body support member 218 is in the upwardly inclined position shown in FIG. 9, most of the weight of the upper body of the patient is directed downwardly onto the center member 217 and only a small portion of the weight is exerted onto member 218, whereas when the member 218 is in a horizontal position, virtually all of the weight of the upper body of the patient is exerted directly downwardly onto the member 218. Thus, it is desirable for the gas spring 251 to exert onto the member 218, in a direction perpendicular to the plane of member 218, a force component which increases progressively in magnitude as the member 218 is pivoted from the inclined position shown in FIG. 9 to a horizontal position. Of course, the conventional gas spring 251 produces a substantially constant force in a direction parallel to its central axis throughout its range of telescopic movement. Therefore, the pivot axles 243 and 248 for the ends of the gas spring must be positioned so that the central axis of the gas spring forms a larger acute angle with respect to the plane of member 218 in the horizontal position of member 218 than in the inclined position of FIG. 9.

In this regard, the cross member 226 in the embodiment of FIG. 9 is not suitable for use as the pivot axle for the lower end of the gas spring 251, because its position is such that the angle between the central axis of the gas spring and the plane of member 218 would be larger when the member 218 is in the inclined position than when the member 218 is in the horizontal position. There would thus be a progressively decreasing force component from the gas spring as the member 218 moved from the inclined position to the horizontal position, which is exactly the opposite of the desired effect. In fact, the force component acting on the member 218 in the inclined position would be sufficiently great so that it would require an uncomfortably large amount of manual exertion to pivot the member 218 downwardly away from its inclined position, especially when no patient was present on the patient support 216. The cross member 226 could in theory be moved to a different location on the frame, but this is not practical in the embodiment disclosed in FIG. 9. In particular, the cross member 226 serves as a primary connection point for the litter support mechanism (which is identical to that shown at 16 in the embodiment of FIG. 1), and this litter support mechanism dictates that cross member 226 must be in substantially the position shown in FIG. 9.

Accordingly, the separate axle 243 is provided, and is located on the frame so that the central axis of the gas spring forms a larger acute angle with respect to the plane of member 218 in the horizontal position of member 218 than in the inclined position of FIG. 9. As a result, the force required to move the member 218 to its horizontal position is comfortable even when no patient is present, and yet the gas spring 251 can provide the desired different degrees of force needed to help support the patient weight in various positions of the member 218. However, this position of axle 243 raises another problem.

In particular, this position of the axle 243 means that, if the cross member 226 extended the full width of the frame, cross member 226 would interfere with pivotal movement of the gas spring 251. Relocating the cross member 226 in order to avoid such interference is, as discussed above, not practical in the preferred embodiment, because of the fact that cross member 226 serves as a connection point for the litter support mechanism. The patient support 216 and axle 243 could alternatively be moved upwardly with respect to the frame and cross member 226, but this would result in an undesirably large vertical height for the overall patient litter 211. Therefore, the embodiment of FIG. 9 takes the approach of splitting the cross member 226 into two axially spaced segments, thereby permitting the gas spring to pass between the segments and achieve its necessary range of pivotal movement.

Since the cross member 226 serves as a connection point for the litter support mechanism, the cross member 226 is subjected to some very large forces during normal use of the stretcher, and as a result it is necessary to securely interconnect the inner ends of the segments of cross member 226 in order to provide cross member 226 and the frame with the strength and rigidity necessary to carry these forces. Therefore, the inner ends of the segments of cross member 226 are rigidly interconnected by the structure shown in FIG. 9 (including plates 227–229, plate. 231 and sleeves 232–233), which in total provides a cross member with the requisite strength and rigidity as well as a recess 242 into which the gas spring can move.

OPERATION

When the releasable locking mechanism is in the operational position shown in FIG. 5, the vertical locking pins 61 and 62 are free of engagement with the locking teeth 97 on the metal strips 91–94, and the cross member 54 can thus move horizontally within the slots in brackets 52 and 53 with respect to the frame of the patient litter 17. As the patient litter 17 is lowered toward the base 12 from the position shown in FIG. 1 toward the position shown in FIG. 8, the telescoping legs 131 and 132 pivot relative to the telescoping legs 133 and 134 about the axle 136. The lower ends of the telescoping legs 131 and 132 thus attempt to move away from the lower ends of the telescoping legs 133 and 134, but since the base 12 is not capable of changing in length, the lower ends of each of the four legs telescope in order to progressively reduce their length so that the axle 136 can move downwardly toward the base. The fixed-length link members 181 and 191 ensure that all four legs telescope progressively in a synchronized manner, in order to maintain the patient litter 17 in a desired orientation in each of its vertical positions. In addition, as the legs 131–132 pivot relative to the legs 133–134 in a direction corresponding to downward movement of the patient litter, the upper ends of the legs 131 and 132 attempt to move away from the upper ends of the legs 133 and 134, which is accommodated by the ability of cross member 54 to slide within the brackets 52 and 53 relative to the frame patient of the patient litter 17.

When the release member 76 is not manually operated, the spring 111 urges the connecting member 107 and metal strips 91–94 rightwardly toward the position shown in FIG. 4, in which the vertical pins 61 and 62 can each engage teeth on two of the strips 91–94. Engagement of the pins 61 and 62 with respective teeth 97 prevents the cross member 54 from moving within the brackets 52 and 53 in a direction toward end member 34. This in turn prevents the upper ends of the telescoping legs 131 and 132 from moving away from the upper ends of telescoping legs 133 and 134, which in turn prevents pivotal movement of legs 131–132 relative to legs 133–134 about axle 136 in a direction corresponding to downward movement of the patient litter 17. Thus, the patient litter 17 can be releasably locked in a selected vertical position.

A safety feature is that the weight of the patient litter 17 tends to cause to the pins 61 and 62 to be firmly urged into the semicircular recesses 99 in the teeth 97. As a result, if the release member 76 is manually pivoted from the normal position shown in FIG. 4 to the release position of FIG. 5, the spring 112 will attempt to pull the metal strips 91–94 leftwardly from the position of FIG. 4 to the position of FIG. 5, but the engagement of the pins 61 and 62 with the sides of the semicircular recesses 99 will prevent leftward movement of the metal strips 91–94 from the position of FIG. 4 to the position of FIG. 5. Locking mechanism 73 is specifically designed so that the patient litter 17 must be subjected to a manual lifting force which is sufficient to lift the patient litter (and any patient or other object thereon) upwardly a small distance relative to the base, so that the patient litter 17 is exerting little or no downward force onto the litter support mechanism 16. It is not sufficient to lift only one end of the patient litter 17; both ends must be lifted so that the patient litter exerts no significant downward force onto the support mechanism 16, and preferably exerts a small upward force onto the litter support mechanism 16. This will cause the litter support mechanism 16 to urge the cross member 54 upwardly in FIGS. 4 and 5, so that the pins 61 and 62 disengage from the semicircular recesses 99. Then, where the release member 74 is manually moved to the position of FIG. 5, the spring 112 can move the metal strips 91–94 leftwardly to the position of FIG. 5, in which the vertical height of the stretcher can be freely adjusted upwardly or downwardly. This safety feature avoids unnecessary risks to a patient on the stretcher, by ensuring that the releasable locking mechanism can only be released when the patient litter and any patient on it are securely manually supported, which in turn avoids the possibly dangerous situation of a rapid drop of the patient litter and an abrupt stop in its lowermost position that could injure a patient.

Referring now to FIG. 9, and as mentioned above, when the operating lever 252 is not manually actuated, the gas cylinder 251 releasably locks the upper body support member 218 in its current pivotal position, whereas when the operating lever 252 is manually actuated, the gas cylinder 251 responds by permitting the upper body support member 216 to pivot from the position shown in FIG. 9 to any position within its range of movement, including an approximately horizontal position. As the member 218 pivots from an inclined position to a horizontal position, the gas cylinder 251 moves from the position shown in solid lines to the position shown in broken lines, or in other words moves into the recess 242 provided in cross member 226.

Although particular preferred embodiments of the invention have been disclosed in detail for illustrative purposes, it will be recognized that variations or modifications of the disclosed embodiments, including the rearrangement of parts, lie within the scope of the present invention.

The embodiments of the invention in which an exclusive property or privilege is claimed are defined as follows:

1. A stretcher, comprising: a wheeled base; a patient litter disposed above said base; a support mechanism which supports said patient litter for vertical movement relative to said base, said support mechanism including elongate first and second support elements which each have first and second ends respectively pivotally coupled to said patient litter and to said base, which can each expand and contract in length, and which are pivotally coupled to each other at locations between the ends thereof for pivotal movement about an approximately horizontal pivot axis, said support mechanism further including a fixed-length link member having a first end supported on said base for pivotal movement about a common axis with said second end of said first support element, and having a second end supported on said second support element at a location axially between said pivot axis and said second end thereof for pivotal movement about a further axis which is substantially parallel to said pivot axis; and selectively actuable locking means for releasably locking said support mechanism so as to respectively permit and prevent vertical movement of said patient litter relative to said base when respectively actuated and deactuated.

2. The stretcher according to claim 1, wherein said first and second support elements each include a tubular outer member having an upper end pivotally coupled to said patient litter, and an inner member telescopically slidably disposed within said outer member and having a lower end pivotally coupled to said base.

3. The stretcher according to claim 2, wherein said second ends of said support elements pivotally supported on said base remain a predetermined distance from each other on said base in all operational positions of said support mechanism, and wherein said first and second support elements each telescope in length at locations between said pivot axis and said second ends thereof.

4. The stretcher according to claim 3, wherein each said inner member has means defining therein a slot which extends lengthwise thereof and transversely therethrough, and including an axle which extends along said horizontal pivot axis through said outer members of each of said first and second support elements and through said slots in said inner members thereof.

5. The stretcher according to claim 3, including a respective tubular accordion-like bellows part disposed around each of said support elements along a portion thereof which telescopes in length.

6. The stretcher according to claim 3, wherein said second end of said link member is secured to said tubular outer member.

7. The stretcher according to claim 2, wherein said second end of said link member is secured to said tubular outer member.

8. The stretcher according to claim 1, wherein said support mechanism includes third and fourth elongate support elements which each have first and second ends respectively pivotally coupled to said patient support and to said base, which can each expand and contract in length, and which are pivotally coupled to each other at locations between the ends thereof for pivotal movement about said horizontal pivot axis, said third and forth support elements being spaced axially along said pivot axis from said first and second support elements, said first and third support elements pivoting about a common pivot axis at said first ends thereof and about a common pivot axis at said second ends thereof, and said second and fourth support elements pivoting about a common axis at said first ends thereof and about a common axis at said second ends thereof, said support mechanism further including a second fixed-length link member having a first end supported on said base for pivotal movement about a common axis with said second end of said third support element, and having a second end supported on said second support element at a location axially between said pivot axis and said second end thereof for pivotal movement about a further axis which is substantially parallel to said pivot axis.

9. The stretcher according to claim 1, wherein said patient litter includes a frame having a fixed member and includes a movable member which is movably supported on said frame, wherein said first end of said first support member is pivotally supported on said fixed member and said first end of said second support member is pivotally supported on said movable member, and wherein said locking means respectively prevents and permits movement of said movable member relative to said frame when respectively actuated and deactuated.

10. A stretcher, comprising: a wheeled base; a patient litter disposed above said base and including a frame; a support mechanism which supports said patient litter for vertical movement relative to said base; and selectively actuable locking means cooperable with said support mechanism for releasably locking said patient litter in a selected vertical position with respect to said base, said locking means including a first locking part movably supported on said frame of said patient litter, said first locking part being coupled to said support mechanism and moving from a first position to a second position as said patient litter moves from an uppermost position to a lowermost position; wherein said locking means includes a second locking part supported on said frame for movement between a release position in which said second locking part is spaced from said first locking part and a locking position in which said second locking part is operatively engaging said first locking part and preventing movement of said first locking part in a direction toward said second position thereof, said locking means additionally including safety means for preventing a release of said locking means except when said patient litter is subject to an external lifting force sufficient so that said support mechanism is substantially free from the exertion thereon of downward forces from said patient litter, said safety means including cooperating means on said first and second locking parts for resisting movement of said second locking part from said locking position toward said release position when said first and second locking parts are engaged and said first locking part is urged toward said second position by said support mechanism.

11. A stretcher according to claim 10, wherein said first locking part moves from said first position to said second position thereof approximately in a first direction, wherein said second locking part moves between said locking and release positions approximately in a second direction perpendicular to said first direction; and wherein said second locking part has therein a recess which opens in a direction opposite said first direction, said safety means including said recess having a surface portion engagable with said first locking part when said first locking part is engaging said recess for preventing movement of said second locking part in a direction from said locking position toward said release position.

12. A stretcher according to claim 10, including a manually operable release member movably supported on said frame of said patient litter for movement between normal and release positions; first resilient means yieldably urging said second locking part toward said locking position thereof, second resilient means extending between said release member and said second locking part and yieldably urging said second locking part toward said release position thereof, said second resilient means exerting on said second locking part a force which is respectively less than and greater than a force exerted thereon by said first resilient means when said release member is respectively in said normal and release positions.

13. A stretcher according to claim 12, wherein said second locking part is an elongate member supported at one end on said frame of said patient litter for pivotal movement about a vertical axis and having therealong at locations spaced radially from said pivot axis a plurality of teeth, one of which engages said first locking part when said second locking part is in said locking position.

14. A stretcher according to claim 13, wherein said first locking part is operationally coupled to a third locking part for movement synchronously therewith, including a further elongate locking member supported for pivotal movement about a vertical axis at one end thereof and having a plurality of teeth therealong at locations spaced radially from the vertical axis which can each serve as a fourth locking part engagable with said third locking part, and including a connecting member extending between and pivotally coupled to ends of said locking members remote from said pivot axes thereof.

15. A stretcher according to claim 14, wherein each of said locking members has two vertically spaced portions which each have therealong said teeth, including a movable member supported on a frame of said patient litter for reciprocal movement in approximately horizontal directions and having two pins extending radially therethrough at spaced locations therealong, said pins each projecting outwardly from opposite sides of said movable member, said pins having upper ends which are respectively said first and second locking parts, opposite ends of each said pin engaging said teeth on respective said vertically spaced portions of a respective said locking member.

* * * * *